United States Patent [19]

Yamashita et al.

[11] 4,261,290

[45] Apr. 14, 1981

[54] ELECTROSTATIC DEVELOPING APPARATUS HAVING A DEVELOPER POWDER MIXING DEVICE

[75] Inventors: Keitaro Yamashita, Saitama; Masahiro Tokumaru, Kumagaya, both of Japan

[73] Assignee: Hitachi Metals, Ltd., Tokyo, Japan

[21] Appl. No.: 973,969

[22] Filed: Dec. 28, 1978

[30] Foreign Application Priority Data

Dec. 29, 1977 [JP] Japan ..... 52-160441

[51] Int. Cl.[3] ..... G03G 15/09

[52] U.S. Cl. ..... 118/658; 222/DIG. 1; 355/3 DD; 366/9; 366/336; 366/337

[58] Field of Search ..... 427/14; 355/3 DD; 222/DIG. 1; 366/336, 337, 9; 118/658, 657

[56] References Cited

U.S. PATENT DOCUMENTS

| | | | |
|---|---|---|---|
| 3,697,050 | 10/1972 | Stanley | 366/337 |
| 4,025,179 | 5/1977 | Hudson | 355/3 DD |
| 4,112,520 | 9/1978 | Gilmore | 366/337 |

*Primary Examiner*—Bernard D. Pianalto

*Attorney, Agent, or Firm*—Finnegan, Henderson, Farabow, Garrett & Dunner

[57] ABSTRACT

A developer powder mixing device used in an electrophotographic developing apparatus comprising stationary mixing chutes which convey developer powder across the centerline of the developer station from one side of the station to the other in both directions as excess developer powder is falling under gravity from a developing roll.

17 Claims, 6 Drawing Figures

FIG. 1
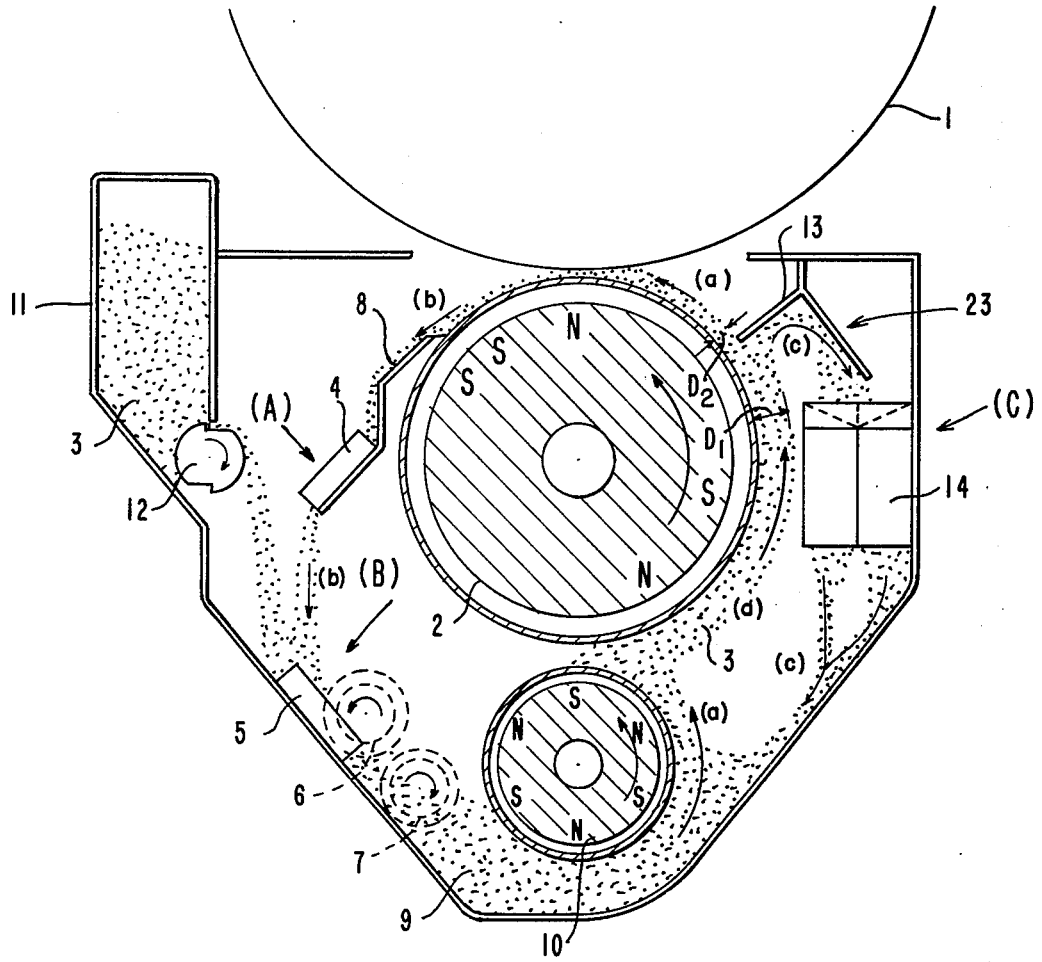
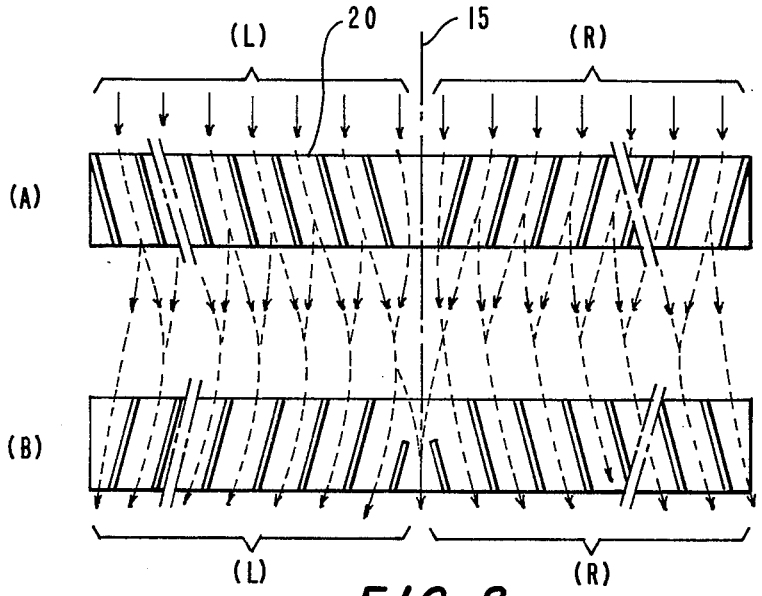
FIG. 2

ELECTROSTATIC DEVELOPING APPARATUS HAVING A DEVELOPER POWDER MIXING DEVICE

BACKGROUND OF THE INVENTION

The present invention relates to electrophotographic developing apparatus and more particularly to devices in such apparatus for mixing the developer powder.

Upon development of electrostatic latent images formed on a light sensitive surface in electrophotographic apparatus, such as electrostatic development machines, it is generally necessary to render the supply of the developer uniform over the entire surface of the developing station. However, where electrostatic latent images formed on the light sensitive surface are present with a lateral deviation of images on the developing surface, the developer on the developing roll is consumed with a deviation in the axial direction of the roll corresponding to the deviation present in the elcetrostatic latent images. Accordingly, the amount of the developer transported by the developing roll is gradually decreased in the portion corresponding to the electrostatic latent images requiring the larger amount of developer. Efforts have therefore been made to incorporate mixing devices in the developing apparatus to restore a uniform supply of developer across the width of the developing station.

One conventional mixing device utilizes assemblies of mixing chutes diverting the developer at slight angles in one assembly of chutes and then in the opposite directions in a second assembly of chutes. Such assemblies may include parallel chutes on both sides of the centerline of the developing station, the chutes on each side being at different angles, but such assemblies do not significantly intermix the developer across the centerline.

Another conventional mixing device employs rotative screw blades across the width of the mixing station. Ordinarily two such screw blades are positioned in consecutive order, the screws rotating in opposite directions with their axes parallel to the developing and transport rolls. In such screw-mixing devices, however, the developer is forcibly transported in the screw blades. Frictional resistance develops between the developer particles themselves, and between the developer particles and the screw blades, resulting in increased fatigue in the developer.

Such fatigue is particularly significant in developers consisting of toner and resin-coated-iron powder in admixture, wherein the fatigue in the resin-coated-iron powder decreases the length of life of the developer.

SUMMARY OF THE INVENTION

A principal object of the invention, therefore, is to improve developer-mixing devices in electrostatic developing apparatus.

It is a second principal object of the invention to intermix developer across the centerline of the developing station without increasing the fatigue of the developer.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the developer mixing device of the invention comprises mixing chutes for deflecting of paths of the developer across the centerline of the developer station in both directions as excess developer is falling under gravity from the developing roll.

The developer mixing device of the invention greatly increases the uniformity of developer supply across the width of the developing station without increasing the fatigue of the developer is simple in structure and effectively utilizes space within the developing apparatus.

The accompanying drawings illustrate one embodiment of the invention and, together with the description, serve to explain the principles of the invention.

BRIEF DESCRIPTION OF THE DRAWINGS

FIG. 1 is a schematic side view of electrostatic developing apparatus utilizing conventional mixing devices together with the mixing device of the invention;

FIG. 2 is a schematic plan view of conventional successive assemblies of mixing chutes as used in the apparatus of FIG. 1;

DESCRIPTION OF THE PREFERRED EMBODIMENT

Figure 3:
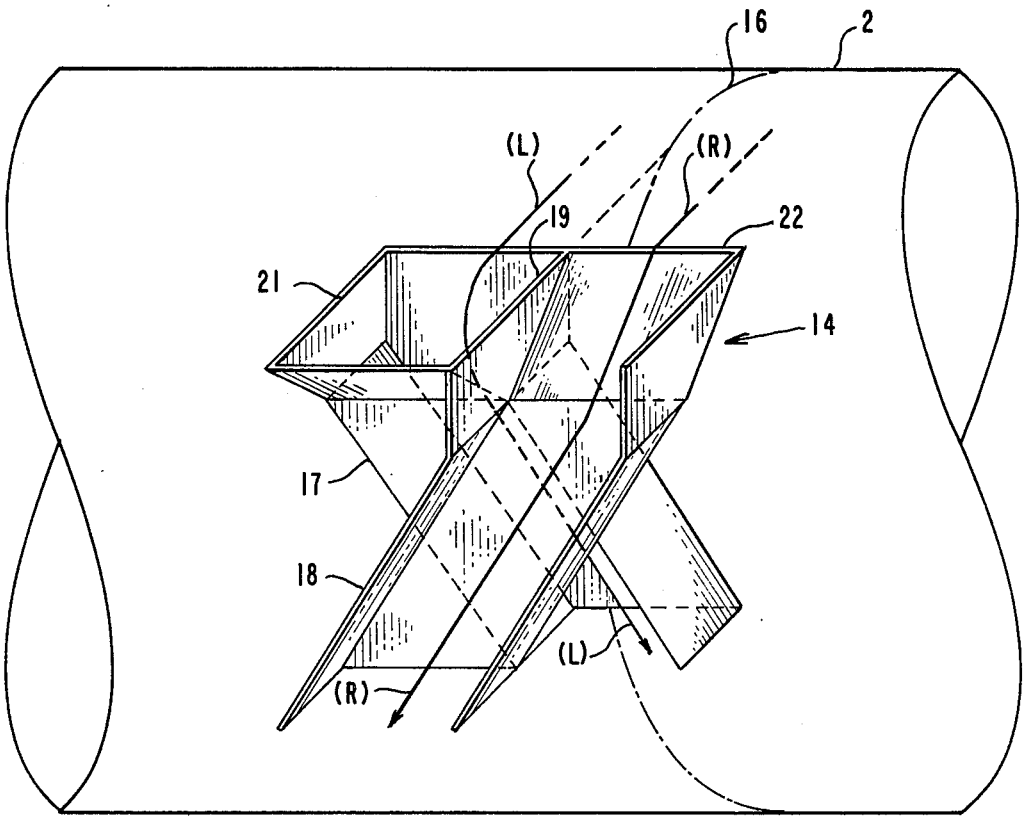
FIG. 3 is a schematic perspective view of the mixing device of the invention as used in the apparatus of FIG. 1.

Reference will now be made in detail to the present preferred embodiment of the invention, an example of which is illustrated in the accompanying drawings.

In FIG. 1, a developing station is shown, including a photoreceptor surface 1 carrying electrostatic latent images formed thereon, a developing roll 2, a developer 3, a first assembly of mixing chutes 4, a second assembly of mixing chutes 5, a scraper 8 for scraping off residual developer, a developer reservoir 9, a transport roll 10, a developer supply tank 11, a ratchet wheel 12, a doctor blade 13 for the control of the amount of the developer on the developing roll 2 to be supplied to the photoreceptor surface 1, and a cross-over mixing device 14 disposed at the axial center of the developing roll 2. D1 represents the thickness of the developer 3 transported by the developing roll 2 and D2 represents the controlled thickness of the developer 3 supplied to the photoreceptor surface 1.

In FIG. 2 the reference numeral 15 represents the centerline of the developing station defined by the projection of the plane of the cross section at the midpoint of the developing roll 2.

For the sake of convenience, the following description is directed to a developer comprising an admixture of toner and carrier, commonly referred to as a two-component developer. The developer mixing device of the invention is just as useful for a magnetic toner conventionally called a one-component developer.

As shown in FIG. 1, toner 3 in the developer supply tank 11 is supplied to the developing apparatus in the desired amount by the rotation of the ratchet wheel 12 to replace the toner consumed from the developer mixture of toner and carrier. The toner 3 passes through the mixing chutes 5 as will be explained later and drops into the developer reservoir 9 at the bottom of the development station for temporary storage.

The transport roll 10 and the developing roll 2 preferably contain permanent magnets, rotate in the same direction, for example counter-clockwise, and carry the developer mixture in the direction of rotation. In the illustrated apparatus, the transport roll 10 is rotatably mounted in the developer reservoir 9, and, upon rotation, carrys the developer within the magnetic field of the developing roll 2 for rotation toward the photoreceptor surface 1.

In order to make constant the amount of the developer to be supplied to the photoreceptor surface 1, the developer 3 being transported in the thickness D1 on the developing roll 2 is controlled to the thickness D2 by the doctor blade 13. The thickness D1 represents the depth of developer 3 attracted to the developing roll 2 by its magnetic field. The thickness D2 is designed to be less than the thickness D1 to provide uniformity to the amount of developer applied to the photoreceptor surface 1.

The doctor blade 13 preferably is intergrally formed as part of a guide plate 23 is specially shaped to deflect excess the developer 3 removed by the blade. The excess developer is deflected outwardly and downwardly, falling then by gravity in the direction (c) in FIG. 1 into the mixing device 14 of the invention to be described in detail with respect to FIG. 3. The guide plate 23 is illustrated as being substantially in the shape of an inverted Y. It is apparent, of course, that its operative surface could be arcuate.

The developer 3 supplied to the photoreceptor surface 1 with its thickness restricted to D2 by the doctor blade 13 develops the electrostatic latent images formed on the surface of the photoreceptor. After the development, the excess developer 3 remaining on the developing roll 2 is scraped off in the direction of an arrow (b) by the scraper 8 disposed near the surface of the developing roll 2 on the opposite side from the doctor blade 13. The developer 3 removed by the scraper 8 falls in the direction of the arrow (b) into the first assembly of mixing chutes 4 and further into the second assembly of mixing chutes 5 and then back into the developer reservoir 9.

The developer 3 is mixed somewhat during the passage through the first and second conventional assemblies of mixing chutes as shown in FIG. 2. The developer 3 falls into the chutes 20 and **20*a* on opposite sides of the centerline 15. The chutes 20 and 20*a* are positioned on a sloping flat bottom plate and include a plurality of vanes on each side of the centerline 15. The vanes on each side of the centerline 15 are respectively parallel but the assemblies of chutes 20, 20*a* are at different angles providing conversion and diversion of the flow through the chutes on each side of the centerline 15. The conversion and diversion can be repeated as often as desired, but there is no effective intermixing across the centerline 15**.

Although the slope, pitch and the like of the first and second mixing chutes 4 and 5 can properly be determined depending upon the type of the developer 3, so as to maximize the mixing effect, the failure to intermix across the centerline 15 is not overcome.

It should be noted that, in the illustrated apparatus, the added toner from the supply 11 falls substantially into the second assembly of mixing chutes 5 so as to be intermingled with the surplus developer 3 removed from the developing roll 2 by the scraper 8.

For purposes of illustration, the conventional screw mixing blades 6 and 7 are shown in dotted lines with their axes in parallel with axis of the transport roll 10. The screw mixing blades are conventionally positioned in succession and operate in opposite directions. As explained earlier such mixing devices increase the fatigue in the developer through the resistance developed between the particles of the developer themselves, and between the particles of the developer and the mixing screws. One of the objects of the invention is to overcome these difficulties. It should be understood the screw mixing devices are shown in FIG. 1 for purposes of illustration and are not part of applicants' improved apparatus.

According to the objects of the present invention, a cross-over device 14 is provided at the position where the excess developer 3 resulting from the action of the doctor blade 13 falls along the direction (c) for effecting mixing across the centerline 15. FIG. 3 shows a perspective view of the cross-over mixing device 14 taken in the direction of the arrow (C) in FIG. 1. Reference numerals 2 and 14 in FIG. 3 correspond respectively to the developing roll and the cross-over mixing device of FIG. 1. Reference numeral 16 represents a cross section at the mid-point of the longitudinal axis of the developing roll 2 and corresponds to the projection plane 15 of the cross section of the mixing chutes 4 and 5 shown in FIG. 2. The cross-over device 14 preferably includes channel means for deflecting the paths of portions of excess developer falling under gravity across the centerline in opposite directions. The channel means is integrally formed with at least two individual crossing chutes 17 and 18 connected to funnel-like member 21 and 22 separated by the partition plate 19 at the center of the entrance opening. The partition plate 19 is provided on the plane of the centerline 16 and bilaterally divides the entrance opening, the chutes being provided in each members.

In FIG. 3, the side plate for the chute 18 of the cross-over device 14 is not shown for the convenience of the explanation. The developer 3 which falls in the direction (c) shown in FIG. 1 under the control of the doctor blade 13 passes, with respect to the centerline 16 for the developing roll 2 as a boundary, in the chute 17 along a solid line (L) on the left side and in the chute 18 along a solid line (R) on the right side. Since the chutes 17 and 18 cross each other, the developer 3 comes out from the outlet of the chutes 17 and 18 crossing over left and right, as shown in FIG. 3. Consequently, mixing for the developer on the left and right sides with respect to the centerline 16, which has been impossible in the mixing chutes 4 and 5, can be effected in the cross-over device 14.

Accordingly, by the combined use of the assemblies of mixing chutes 4 and 5 and the cross-over device 14, the developer 3 can effectively be mixed over the entire area of the axial direction of the developing roll 2. Since the space in the developing apparatus can effectively be utilized upon provision of the cross-over device 14, there is no need for increasing the size of the developing apparatus. Moreover, since the mixing for the developer 3 by the cross-over device 14 is effected in the gravitational falling state of the developer without being affected by the magnetic force developed by the permanent magnets incorporated in the developing roll 2 and the transport roll 10, the mixing effect is improved. In addition no increase in fatigue in the developer results such as is generated by the mixing with the screw.

Reference will now be made to the results of mixing experiments of the developer according to the present invention. This experiment was conducted with two-component type developer.

Figure 4:
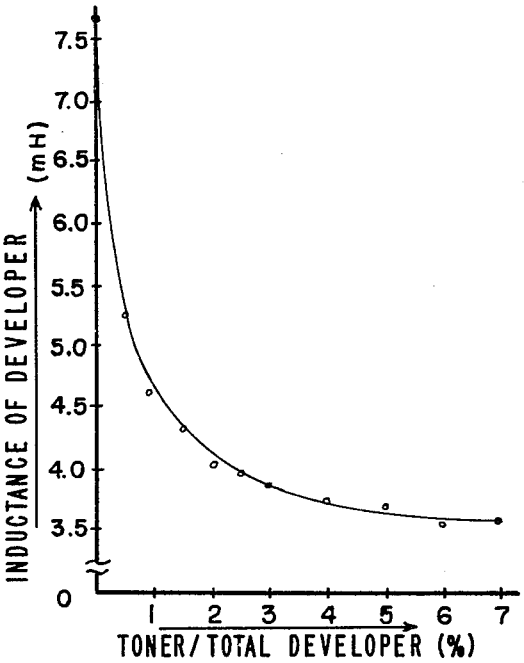
FIG. 4 is a graph showing the relation of the inductance of developer mixture with the ratio of toner to the total developer using so-called two-component type developer.

FIG. 4 shows a relation between the inductance of a developer mixture as compared with the ratio of toner to the total amount of developer in a two-component type developer. The inductance of the two-component type developer consisting of non-magnetic toner and magnetic carrier is determined by the mixture ratio between the toner and the carrier. More specifically, the inductance of the two-component type developer goes lower as the toner mixing ratio is greater. The relation is shown in FIG. 4. Two-component type developers having 2–3% of toner mixing ratio are usually employed. In this experiment, toner was supplied from a portion in the developing apparatus and, upon examination of the state of the toner as supplied and mixed to the axial direction of the developing roll, the developer was sampled out at three points, that is, at both ends and the center of the developing roll. The inductances of the developer sampled out at the above three positions were measured and they were compared to each other to evaluate the mixing state.

Figure 5:
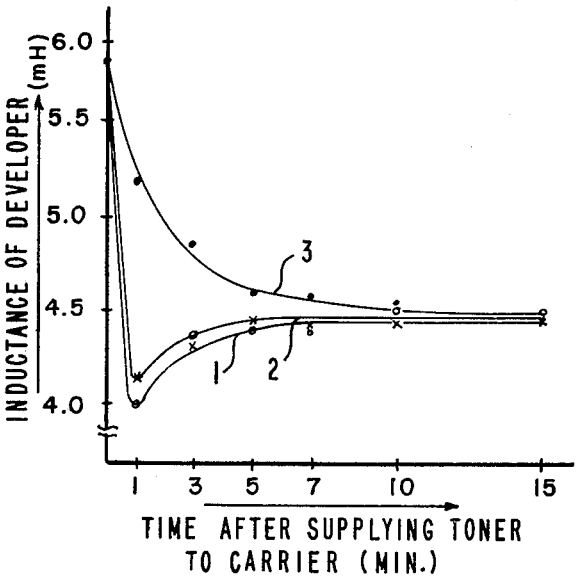
FIG. 5 is a graph showing the relationships of the inductance of developer mixture with respect to time utilizing only the mixing devices of FIG. 2.

FIG. 5 is a graph showing the relation of the inductance of the developer mixture with respect to time utilizing only the assemblies of mixing chutes 4 and 5. The toner was supplied to the left end of the developing roll and sampled out with the elapse of time at three points, that is, at the left end, the center and the right end of the developing roll 2. In FIG. 5, the numerals 1, 2 and 3 represent data at the left end, at the center and at the right end of the developing roll, respectively. As shown, while the toner supplied at the left end could be well mixed in a short time as far as the center portion, it required about 10 minutes for uniform mixing at the right end.

Figure 6:
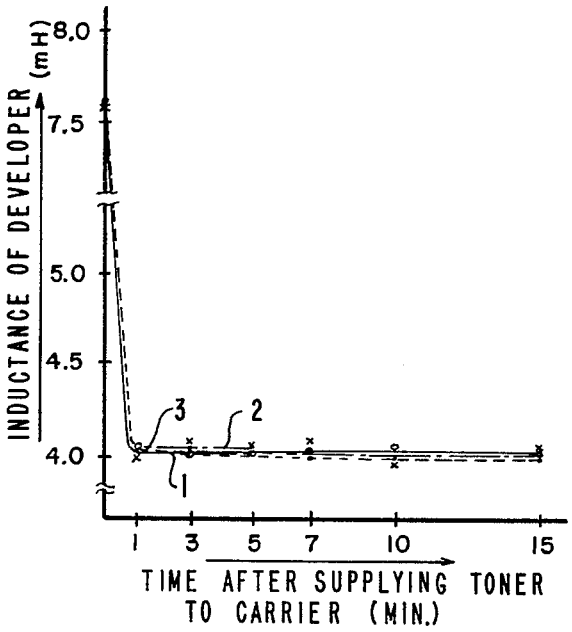
FIG. 6 is a graph showing the same relationships as the graph of FIG. 5 but utilizing both the mixing devices of FIG. 2 and the mixing device of the invention.

FIG. 6 shows the result for a measurement similar to that illustrated in FIG. 5 but with the combined use of the assemblies of mixing chutes 4 and 5 and the cross-over device 14. From this graph it can be seen that uniform mixing had been effected for the entire length of the developing roll within one minute. The above experimental result demonstrates that the developer mixing means according to the present invention is highly effective for the mixture of the developer.

As the transport roll 10, it is preferable to use a magnetic roll which comprises a rotatable cylindrical non-magnetic shell, a cylindrical magnet coaxially incorporated in the shell and a shaft on which the magnet is mounted. The magnet has a plurality of magnetic poles axially elongated in the cylindrical surface of the magnet. And the adjacent magnetic poles have opposite polarities. Such a magnetic roll is described in Anderson U.S. Pat. No. 3,455,276 and Samuels et al. U.S. Pat. No. 4,003,334.

As the developing roll 2, it is possible to use the same type of magnetic roll as the transport roll. Alternatively, the magnetic roll described in Yamashita et al. U.S. Pat. No. 3,828,730 may be used. The Yamashita et al. magnetic roll comprises a cylindrical permanent magnet having an odd number of axially extending magnet poles on the surface thereof. The cylindrical magnet is disposed coaxially and stationarily within a hollow rotary cylinder of non-magnetic material. The magnet has one magnetic pole at the opposite position to the photoconductor and two magnetic poles with the same polarity at a position near the scraper blade.

As described above, according to the present invention, a developing apparatus having a developer mixing device is provided in which the mixing of the developer in the axial direction of the developing roll can rapidly be effected in a short time and the developer life can be increased by the utilization of the gravitational falling of the developer which eliminates the fatigue in the developer resulting from the conventional screw mixing. In addition, the mixing device of the invention is simple in structure and takes only a small space.

What is claimed is:

1. In apparatus for developing an electrostatic latent image with developer powder, the apparatus including a reservoir for holding the developer powder, a developing roll for transporting the developer powder to the latent image, and means for removing excess powder from the roll and for releasing the excess powder to the force of gravity for return to the reservoir, the removing means being positioned upstream of the latent image and downstream of the reservoir with respect to the direction of movement of the developer powder on the developing roll, and the apparatus further including combined means positioned downstream of the latent image and upstream of the reservoir for receiving surplus developing powder from the developing roll, mixing the surplus powder across the width of the apparatus, and returning the mixed surplus powder to the reservoir, the improvement comprising:

stationary second mixing means positioned upstream of the latent image, downstream of the reservoir, and adjacent said removing means, said second mixing means including (a) bilateral means for receiving said excess powder removed upstream of the latent image and falling under the force of gravity and dividing the falling powder into portions on each side of the axial center of the roll; and (b) channel means for deflecting the paths of the falling portions across the axial centerline in opposite directions.

2. The apparatus improvement of claim 1 wherein said means for removing excess powder includes a doctor blade and wherein said improvement also includes means associated with said doctor blade for directing said excess powder toward said bilateral means.

3. The apparatus improvement of claim 2 wherein said excess powder directing means is integral with said doctor blade.

4. The apparatus improvement of claim 2 wherein said doctor blade standardizes the depth of developer powder on said developer roll before the development of said latent image, and wherein said excess-powder results from such standardization.

5. The apparatus improvement of claim 1 wherein said bilateral means includes at least a pair of funnel-like members and said channel means includes an even number of chutes, each chute having an upper opening connected to one of said funnel-like members on one side of said axial center and a lower opening on the other side of said axial center.

6. The apparatus improvement of claim 5 wherein said bilateral means includes a partition at said axial center separating said funnel-like members.

7. The apparatus improvement of claim 6 including a funnel-like member on each side of said partition and a chute connected to each of the funnel-like members.

8. The apparatus improvement of claim 1 wherein the combined means includes means for scraping surplus developer from the developer roll after the development.

9. The apparatus improvement of claim 1 wherein the combined means includes means for converging the surplus developer with respect to the axial centerline.

10. The apparatus improvement of claim 1 wherein the combined means includes means for diverging the surplus developer with respect to the axial centerline.

11. The apparatus improvement of claim 1 wherein the combined means includes means for alternately converging and diverging the surplus developer with respect to the axial centerline.

12. The apparatus improvement of claim 1 wherein the combined means includes means for mixing the surplus developer with newly supplied toner.

13. An electrostatic developing apparatus for developing latent images formed on a photoreceptor surface with developer powder, comprising:

(a) a reservoir for storing the developer powder;

(b) a magnetic roll including a shaft, a permanent magnet mounted around the shaft, the permanent magnet having a plurality of magnetic poles axially elongated on the surface of the magnet, and a non-magnetic cylindrical shell relatively rotatable with respect to the magnet, the magnetic roll facing the photoreceptor surface to convey the developer powder from the reservoir to the photoreceptor surface and to develop the latent images on the photoreceptor;

(c) a guide plate having a doctor blade at the end thereof facing the magnetic roll, the guide plate being positioned on the path of the developer powder being conveyed along the surface of the magnetic roll so as to restrict the amount of the developer powder to be conveyed to the photoreceptor, to lead the excess of the developer powder away from the surface of the magnetic roll and to let the excess of the developer powder gravitationally fall to the developer reservoir;

(d) a cross-over device positioned upstream of the latent image, and downstream of the reservoir on the route of the falling developer powder from the guide plate, the cross-over device including an even plurality of chutes for leading the falling developer powder downwards, each of the chutes having side walls separating the chute from the others, and upper opening for receiving the falling developer powder on one side of a plane normal to the longitudinal axis of the magnetic roll at the midpoint and a lower opening, for leading the received developer powder to the reservoir, on the other other side of the said plane, half of the number of the upper openings being on each side of plane; and (e) combined means for receiving residual powder remaining on said magnetic roll after development of the latent image, mixing said received residual powder across the width of the apparatus, and returning the mixed residual powder to said reservoir.

14. The apparatus as set forth in claim 13, wherein the number of the chutes is two.

15. The apparatus as set forth in claim 14, wherein a partition wall between the two chutes is on said plane.

16. The apparatus as set forth in claim 13, wherein said combined means includes a left mixing part and a right mixing part with respect to the said plane, each part having a sloping flat bottom plate and a plurality of parallel vanes mounted vertically on the flat bottom plate and slanting to said plane, and wherein the apparatus further comprises a developer powder supply tank, said left and said right parts also being positioned on the route of conveying developer powder from said supply tank to the reservoir.

17. The apparatus as set forth in claim 13 wherein said combined means includes a scraper which is positioned in a contact relation with the surface of the magnetic roll so as to scrape the residual developer powder after the development of the latent image.

* * * * *